US006085438A

United States Patent [19]

Fleissner

[11] Patent Number: 6,085,438

[45] Date of Patent: Jul. 11, 2000

[54] DEVICE FOR THROUGH-FLOW CONTINUOUS HEAT TREATMENT OF TEXTILES, TISSUE, OR THE LIKE

[75] Inventor: Gerold Fleissner, Zug, Switzerland

[73] Assignee: Fleissner GmbH & Co., Maschinenfabrik, Egelsbach, Germany

[21] Appl. No.: 09/371,030

[22] Filed: Aug. 10, 1999

[30] Foreign Application Priority Data

Aug. 10, 1998 [DE] Germany ..... 198 36 027

[51] Int. Cl.[7] ..... F26B 13/18

[52] U.S. Cl. ..... 34/122; 34/123; 68/5 D

[58] Field of Search ..... 34/108, 109, 110, 34/111, 114, 115, 122, 123; 68/5, 158

[56] References Cited

U.S. PATENT DOCUMENTS

| | | | |
|---|---|---|---|
| 4,811,574 | 3/1989 | Fleissner | 68/5 D |
| 5,052,197 | 10/1991 | Fleissner | 68/5 D |
| 5,609,046 | 3/1997 | Fleissner | 68/5 D |

FOREIGN PATENT DOCUMENTS

| | | | |
|---|---|---|---|
| 3821330 A1 | 12/1989 | Germany | D06B 5/02 |
| 19636592 A1 | 3/1998 | Germany | D06B 5/02 |

*Primary Examiner*—Denise Ferensic
*Assistant Examiner*—Michelle A. Mattera
*Attorney, Agent, or Firm*—Antonelli, Terry, Stout & Kraus, LLP

[57] ABSTRACT

A screen drum design is known whose drum jacket consists of sheet metal strips running axially and whose width extends in the radial direction. These sheet metal strips must be permanently connected with the endwise bottoms to produce the drum jacket. According to the invention, this connection is made movable. For this purpose, an articulated ring (32) is used that consists of a number of connecting arms (13) mounted pivotably, said arms being connected with articulation at their free ends either with sheet metal strip structure (13, 14) or with bottoms (11, 12) that are located at a distance from the ends of sheet metal strips (13). In this way, movement is always possible between the drum jacket and bottoms (11, 12) to compensate for dimensional changes as a result of temperature fluctuations.

8 Claims, 2 Drawing Sheets

Fig. 3
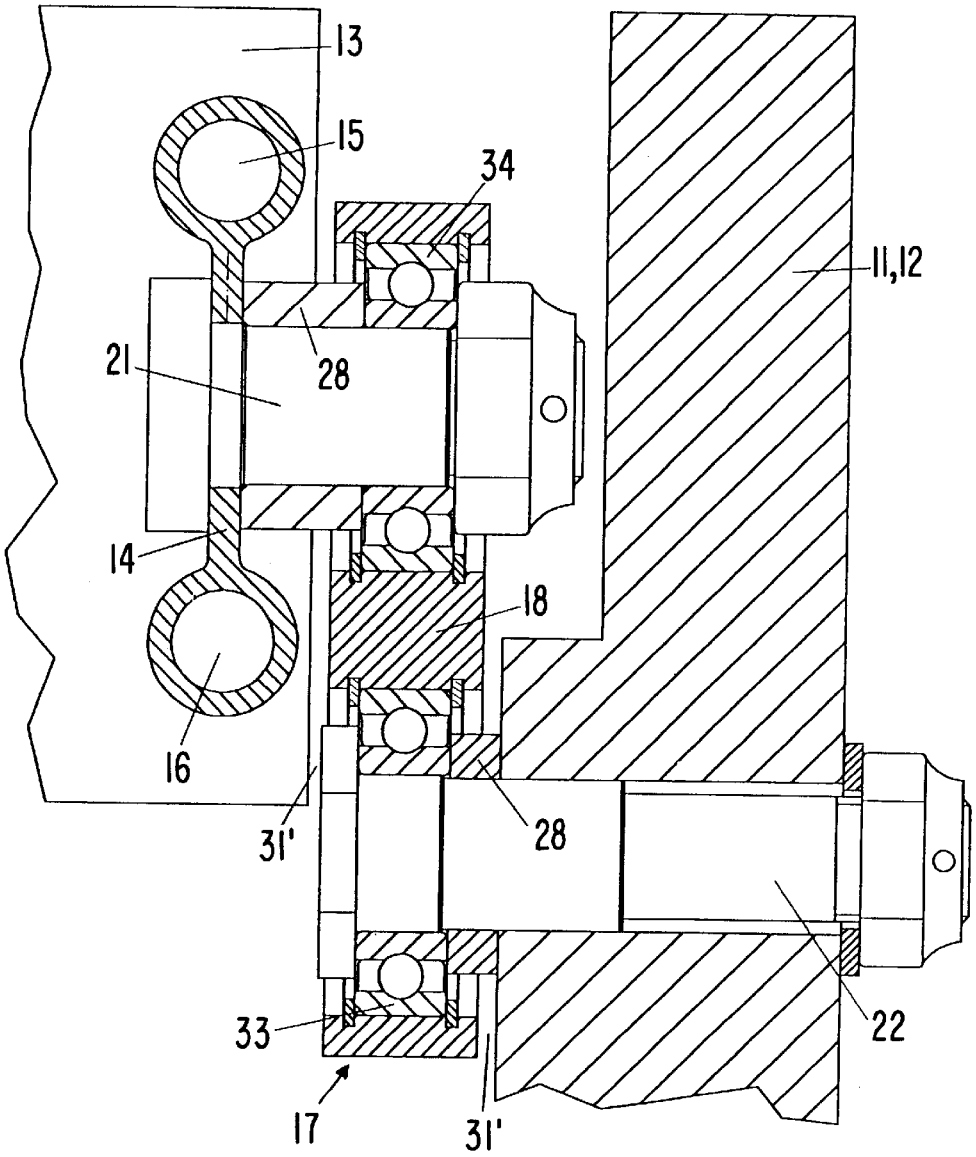
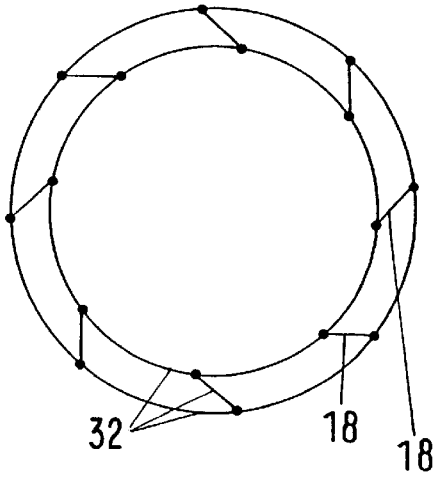
Fig. 4

DEVICE FOR THROUGH-FLOW CONTINUOUS HEAT TREATMENT OF TEXTILES, TISSUE, OR THE LIKE

DE-A-38 21 330 teaches a device for through-flow continuous heat treatment of web-form textiles, nonwovens, or paper with a gaseous processing medium being circulated in the device, said device having a drum as the transport element, said drum being permeable, having endwise bottoms, and being subjected to a vacuum, said drum also being covered on its circumference with a screen-type or perforated covering, with sheet metal strips connected with the bottoms between the bottoms of the drum, extending from bottom to bottom, and with connecting ribs bolted all the way round with the sheet metal strips extending between the sheet metal strips, with the widths of said ribs each extending in the radial direction to produce the drum jacket structure.

This design has the advantage that the drum is optimally permeable to air without the stability of the drum being reduced thereby. Another advantage is the bolted construction used in this device. In this fashion, all the drum jacket elements are permanently connected with one another through the bolted rib connections by the connecting ribs extending in the circumferential direction, with the sheet metal strips extending along the drum all the way round the drum.

The connections between the sheet metal strips and the drum jacket structure with the bottoms of the drum, in other words with one bottom and with the nozzle star by which the fan produces a vacuum in the interior of the drum, is subjected to powerful thermal stresses during practical use. The bottoms have a higher heat capacity then the sheet metal strips. When a cold material enters the heated drum housing, the sheet metal strips cool off abruptly on contact with the material; this does not initially affect the bottoms, so that considerable stress is developed in the material that could cause cracks or dents in the drum.

To avoid this, the design according to DE-A-196 36 592 is provided. In this document, a connection is formed between the sheet metal strips and the respective adjacent bottoms of the drum which permits constant equalization in this area of the changes in material dimensions caused by temperature changes, so that there are no increased material stresses on the drum bottoms, especially not in the vicinity of the connections to the sheet metal strips. This is made possible on a connecting element that permanently connects the sheet metal strips with the associated bottoms and is nevertheless articulated. The articulated connection is produced by a bolted construction that connects the bottom and the associated end of the sheet metal strip by permanently tightened bolts.

The connecting element according to DE-A-196 36 592 is quite expensive with its three bolts, in addition to which it engages the ends of the sheet metal strips that run perpendicularly to the bottoms. The goal of the invention is to simplify the design and at the same time to ensure that a drum that is stable in the long term is produced which nevertheless yields to all thermal expansions.

Taking its departure from the basic idea according to DE-A-196 36 592, provision is made for achieving the stated goal such that the connecting element consists of a plurality of connecting arms arranged in a circle around the axis of the drum, each of said arms being movably connected at its respective ends firstly with the drum jacket structure and secondly with the associated bottom, with the connecting arms extending not radially but at an angle to the radial that is provided greater than 0 degrees or less than 90 degrees to the tangential. This simplified design has the advantage that when there are dimensional changes in the radial direction, movements are possible in the radial direction in the connection between the drum jacket and the jacket structure.

A special advantage is obtained when the bolted connection for fastening the connecting arms to the drum jacket structure engages not the sheet metal strips but directly the connecting ribs between the sheet metal strips. For this purpose, the connecting ribs should be provided over their radial heights with bores through which the bolts on one end of the connecting arm are pushed so that the drum jacket is held to the bottoms by the individual connecting ribs.

Special designs of the connecting element are the subject of the invention. They are disclosed in additional claims and in the drawings provided as examples with a description of the figures.

FIG. 1 shows a section lengthwise through a conventional screen drum device whose sheet metal jacket in this case consists of a strip-shaped sheet metal jacket structure with a screen fabric applied externally;

FIG. 2 indicates the mobility of the sheet metal strips relative to the endwise bottoms;

FIG. 3 shows detail III according to FIG. 1 in an enlarged view; and

FIG. 4 shows only in principle the end view of the entire drum in the vicinity of the connecting arms that extend only in the radial direction, but on a considerably reduced scale relative to FIG. 3.

Figure 1:
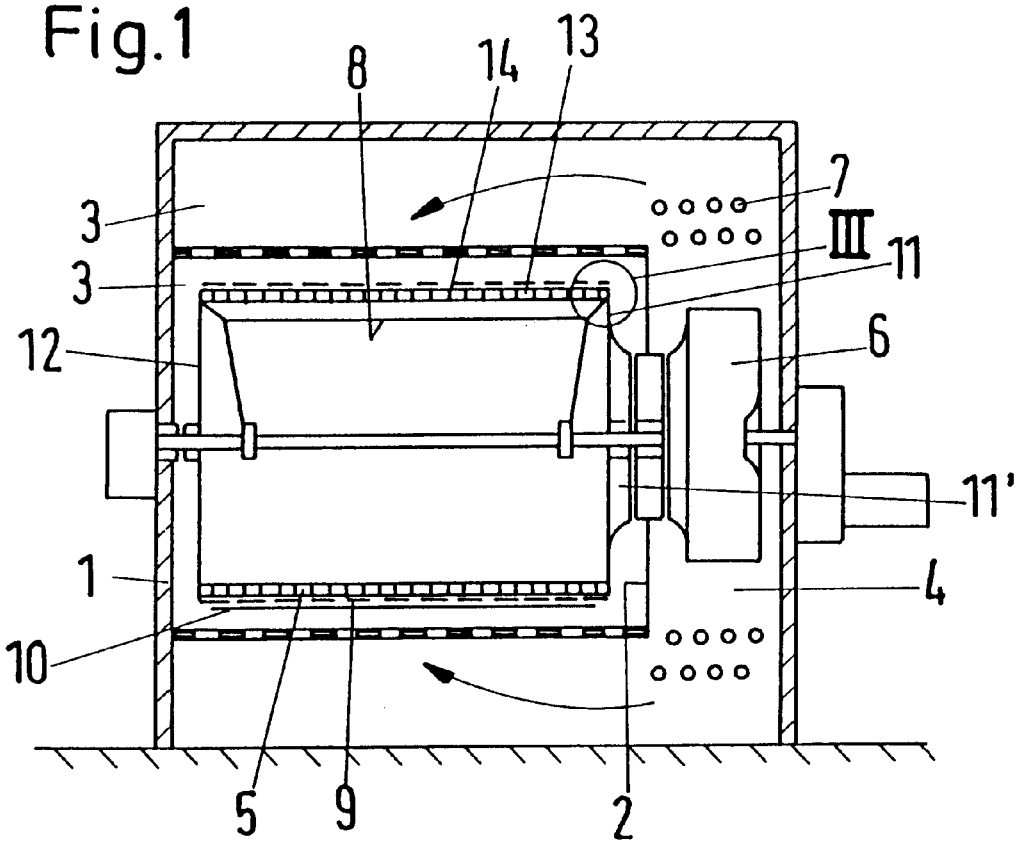

A screen drum device basically consists of an approximately rectangular housing 1 divided by a partition 2 into a processing chamber 3 and a fan chamber 4. The screen drum 5 is rotatably mounted in processing chamber 3 and a fan 6 is rotatably mounted in a fan chamber 4. concentrically to the drum. Of course, the fan chamber can also be located in a fan housing that is separate and separated from screen drum housing 1 and is not shown here. In any event, the fan subjects the interior of drum 5 to a vacuum. The drum structure of a wet-treatment device which can also serve only for exhausting fluid is also the subject of the patent. The entire structure is then adapted accordingly.

According to FIG. 1, heating assemblies 7 are provided above and below fan 6, said assemblies consisting of pipes through which heating medium flows. The screen drum is sealed off against the vacuum internally by an internal covering 8 in the area not covered by textile 10. The jacket structure of the screen drum that supports textile 10 is formed by the sheet metal strip structure described below. This is wrapped externally by a fine-mesh screen 9 that is held tensioned against the end of the drum at bottom 12 and at bottom 11 by nozzle star 11'.

The sheet metal strip structure consists of axially aligned sheet metal strips 13 whose radially aligned heights are clear from FIG. 3. The screen type covering 9 rests only on the radially external edges of sheet metal strips 13. Sheet metal strips 13 are arranged side by side a specific distance apart. In order for this distance to be fixed over the circumference of the drum, connecting ribs that serve as spacers and are designated as a whole by 14 are provided and are connected with sheet metal strips 13 by means of bolts 15 and 16 extending over the circumference.

Figure 2:
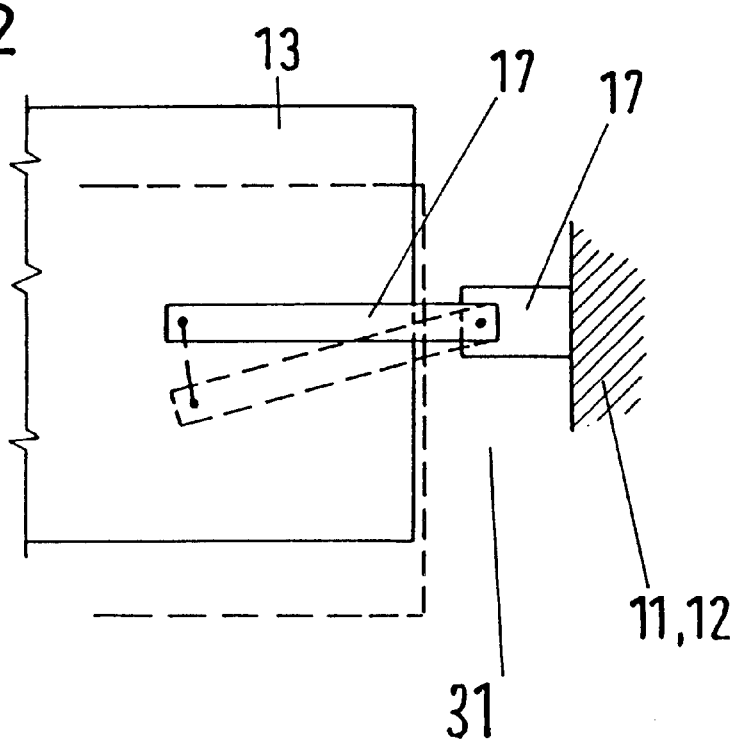

Sheet metal strips 13 must be connected with bottoms 11, 12, because they support textile 10 pressed firmly by the suction against the drum jacket formed by parts 13, 14. On the other hand, during operation, as a result of temperature changes, material stresses develop, especially in the vicinity of the connection of the drum jacket with the drum bottoms, said stresses being capable of destroying a rigid connection. It is therefore advantageous to provide a movable connection at this point. This is shown in principle in FIG. 2. The sheet metal strip structure 13, 14 is intended to be fastened movably to bottoms 11, 12. This is accomplished with a connecting element 17 fastened with articulation at one end to bottom 11, 12 and at the other end to sheet metal strip structure 13, 14. Since an air gap 31 is also left between the end of sheet metal strip 13 and the associated wall of bottom 11, 12, the sheet metal strip 13 can now easily be displaced upward or, as shown by the dashed lines, downward, even during operation.

This principle is implemented in the design according to FIG. 3 whose structure has been thought out. The movable connection is produced exclusively by connecting elements 17 aligned in a radial plane that are arranged in a ring between the respective bottoms 11, 12 and the sheet metal strip structure 13, 14. Therefore, the articulated ring 32 shown in FIG. 4 in principle is located in a gap 31 according to FIG. 2. Articulated ring 32 consists of a plurality of connecting arms 18 designed as connecting elements which are not aligned radially but are inclined in the radial plane along a secant, in other words relative to the radial at an angle greater than 90 degrees but less than 180 degrees. Connecting arms 18 do not have to engage at every connecting rib 14 around drum 5, but advantageously at every second or third connecting rib 14. Connecting arms 18 are then each held with articulation on two diameters: the one that is located radially inward is connected by bolt 22 to bottoms 11, 12 in the embodiment and the one that is located radially outward is connected by bolt 21 to sheet metal strip structure 13, 14. Thus, when there is a change in the diameter of the drum, a reversible adjustment to drum bottom 11, 12 can take place, for example when there is an increase in the diameter of the drum, connecting arms 18 align themselves so that the enclosed angle of the connecting arms 18 to the radial is increased.

In order to make this possible, according to FIG. 3 the connecting arms 18 each have at their ends a bore through which a bolt 21 or 22 is pushed and is bolted either to the sheet metal strip structure 13, 14 or the associated bottom 11, 12. To fasten connecting arms 18 to the drum jacket structure 13, 14, the connecting ribs that are permanently connected by the ring bolts 15, 16 to the sheet metal strips 13 have a bore in the radial center through which bolt 21 is then pushed which then also simultaneously extends radially externally through connecting arm 18. Connecting arm 18 is then held radially internally by bolt 22 through a bore in bottom 11, 12. Between connecting arm 18 and the connecting rib 14 on the one hand and between the connecting arm 18 and the bottom 11, 12 on the other hand, a spacing ring 28 is pushed onto threaded bolts 21, 22, said ring having a length such that an air gap 31' is left to allow friction-free movement of articulated ring 32.

In order to avoid any material stresses caused by dimensional changes in drum 5, the movement must be as free of friction as possible at articulated ring 32. In order to accomplish this optimally in the device shown, bolts 21, 22 are mounted in articulated arm 18 in ball bearings 33, 34. Here, however, not only the grooved bearings shown but also needle bearings or special slide bearings can be used.

What is claimed is:

1. Device for through-flow continuous heat treatment of web-form textiles, nonwovens, or paper with a gaseous processing medium circulated in the device, with a drum (5) that is permeable, under vacuum, and has bottoms (11, 12) endwise as the transport element, said drum being covered on its circumference by a screen-type or perforated covering (9), with sheet metal strips (13) connected with the bottoms (11, 12) between the bottoms (11, 12) of drum (5), extending from bottom (11) to bottom (12), and with connecting ribs (14) bolted all the way round with the sheet metal strips (13) and extending between the sheet metal strips (13), with the widths of said ribs each extending in the radial direction to produce the drum jacket structure (13, 14), to fasten this drum jacket structure (13, 14) with bottoms (11, 12) a connecting element is provided that is permanently connected with drum jacket structure (13, 14) and also with associated bottoms (11, 12) and yet is made articulated, characterized in that the connecting element consists of a plurality of connecting arms (18) arranged circularly around the axis of drum (5), said arms having their respective ends movably connected firstly with drum jacket structure (13, 14) and secondly with associated bottoms (11, 12), with connecting arms (18) not extending radially but at an angle to the radial that is provided larger than 0 degrees but less than 90 degrees to the tangential.

2. Device according to claim 1, characterized in that connecting arms (18) each have at their ends a bore through which a bolt (21, 22) is pushed, said bore being on the one hand bolted directly to drum jacket structure (13, 14) and on the other hand to the associated bottom (11, 12).

3. Device according to claim 1 characterized in that each connecting arm (1) is secured movably on drum jacket structure (13, 14) even when drum (5) is operating.

4. Device according claim 1, characterized in that an air gap (31, 31') that permits drum jacket structure (13, 14) to move relative to bottoms (11, 12) is provided between the end of drum jacket structure (13, 14) and the associated bottom (11, 12).

5. Device according to claim 2, characterized in that the screw connection at one end of connecting arm (18) engages the drum jacket structure directly at connecting rib (14) between sheet metal strips (13).

6. Device according to claim 5, characterized in that connecting rib (14) is provided over its radial height with a bore through which bolt (21) of one end of connecting arm (18) is pushed so that drum jacket (13, 14) is secured to individual connecting ribs (14).

7. Device according to claim 3, characterized in that the movable connection between drum jacket structure (13, 14) and drum bottoms (12, 13) is produced by slide bearings such as ball bearings (33, 34) in particular.

8. Device according to claim 7, characterized in that slide bearings such as ball bearings (33, 34) in particular and thus threaded bolts (21, 22) are mounted in connecting arms (18).

* * * * *